US007475571B2

(12) United States Patent
Koo et al.

(10) Patent No.: US 7,475,571 B2
(45) Date of Patent: Jan. 13, 2009

(54) CONTROLLING METHOD OF WASHING MACHINE

(75) Inventors: Bon Kwon Koo, Changwon (KR); In Haeng Cho, Changwon (KR)

(73) Assignee: LG Electronics Inc., Seoul (KR)

( * ) Notice: Subject to any disclaimer, the term of this patent is extended or adjusted under 35 U.S.C. 154(b) by 691 days.

(21) Appl. No.: 10/499,343

(22) PCT Filed: Nov. 25, 2003

(86) PCT No.: PCT/KR03/02544

§ 371 (c)(1),
(2), (4) Date: Jun. 17, 2004

(87) PCT Pub. No.: WO2004/048674

PCT Pub. Date: Jun. 10, 2004

(65) Prior Publication Data

US 2005/0015891 A1 Jan. 27, 2005

(30) Foreign Application Priority Data

Nov. 26, 2002 (KR) ..... 10-2002-0074072
Nov. 26, 2002 (KR) ..... 10-2002-0074073
Nov. 26, 2002 (KR) ..... 10-2002-0074074

(51) Int. Cl.
*B08B 3/04* (2006.01)

(52) U.S. Cl. ..... 68/3 R; 8/158

(58) Field of Classification Search ..... 68/3 R
See application file for complete search history.

(56) References Cited

U.S. PATENT DOCUMENTS

| | | | | |
|---|---|---|---|---|
| 5,161,393 | A | 11/1992 | Payne et al. | |
| 5,671,493 | A | 9/1997 | Moon | |
| 5,704,136 | A * | 1/1998 | Cho | 34/562 |
| 6,609,264 | B2 * | 8/2003 | Ruhl et al. | 8/158 |
| 2002/0040259 | A1 | 4/2002 | Lee et al. | |

FOREIGN PATENT DOCUMENTS

| | | | |
|---|---|---|---|
| CN | 1378005 | A | 6/2002 |
| JP | 63-127793 | A | 5/1988 |
| JP | 02286197 | A | 11/1990 |
| JP | 04347197 | A | 12/1992 |
| JP | 05092096 | A | 4/1993 |
| JP | 05277282 | A | 10/1993 |
| JP | 63181792 | | 7/1998 |
| JP | 10201989 | A | 8/1998 |
| JP | 2000233095 | A | 8/2000 |
| JP | 2000279686 | A | 10/2000 |
| JP | 2002095888 | A | 4/2002 |

* cited by examiner

*Primary Examiner*—Frankie L Stinson
*Assistant Examiner*—Samuel A Waldbaum
(74) *Attorney, Agent, or Firm*—McKenna Long & Aldridge LLP

(57) ABSTRACT

There is provided a reliable method for sensing a laundry amount and a method for controlling a washing machine, in which a method for sensing a laundry amount is performed appropriately according to the laundry amount. According to the method of the present invention, the reliability in the sensed laundry amount is improved.

7 Claims, 6 Drawing Sheets

CONTROLLING METHOD OF WASHING MACHINE

This application claims priority from Korean Patent Application No. 2002-74072 filed Nov. 26, 2002, Korean Patent Application No. 2002-74073 filed Nov. 26, 2002 and Korean Patent Application No. 2002-74074 filed Nov. 26, 2002, which are hereby incorporated by reference as if fully set forth herein.

TECHNICAL FIELD

The present invention relates to a method for controlling a washing machine, and more particularly to a method for controlling a washing machine, in which a laundry amount received in a tub is sensed and washing/rinsing/dewatering cycles are carried out appropriately according to the sensed laundry amount.

BACKGROUND ART

Generally, fully automatic washing machines are products that remove a variety of dirt adhered to clothes, bedclothes and the like by using sulphurization of a detergent, frictional action of a water current, impact action applied to the laundry by a pulsator, and the like. According to the fully automatic washing machines, an amount and kind of laundry is sensed by means of a sensor and a washing mode is set automatically. A washing water is supplied up to an appropriate level according to an amount and kind of laundry and a washing operation is then performed under the control of a micro computer.

In addition, according to a conventional method for driving a fully automatic washing machine, a torque of a driving motor is transferred through a power transmission belt and a pulley to a washing shaft or a dewatering shaft, thereby rotating a pulsator or a dewatering tub.

Hereinafter, an operation of controlling a conventional washing machine will be described in brief.

First, if the user inputs a washing command, a laundry amount is sensed in an initial operation of the washing machine and washing water is supplied according to the sensed laundry amount. Then, a series of washing, rinsing and dewatering cycles are performed according to the sensed laundry amount. Meanwhile, a method using an applied power of the motor and the number of revolutions of the motor has been proposed for sensing the laundry amount in the initial operation of the washing machine.

However, in order to sense the number of revolutions of the motor, the belt and the pulley are intervened between the driving motor and the tub that receives the laundry, thereby causing a problem that an amount of rotation is not fully transferred to the motor. Therefore, there occurs an error in the laundry amount sensed by the number of revolutions of the motor. Further, there occurs a great error in the sensed laundry amount since an extension of the belt and a tension applied to the belt are different according to a temperature of the washing machine or a season.

Meanwhile, if necessary, the user opens the door of the washing machine and loads the laundry additionally during the washing operation. At this time, the related art has a disadvantage in that the user manipulates all washing cycles all over again in order to perform the washing cycles all over again. Further, in case the washing operations are performed successively and there is no additional water supply, the washing water is supplied less than an appropriate quantity. Therefore, there occurs a problem that degrades the washing performance or increases the washing load. Further, in case many loads are applied to the driving unit of the washing machine, parts may be degraded more seriously.

DISCLOSURE OF THE INVENTION

Accordingly, the present invention is directed to a method for controlling a washing machine that substantially obviates the problems caused by limitations and disadvantage of the conventional one.

One object of the present invention is to provide a method for controlling a washing machine, in which a laundry amount received in the tub is sensed more accurately.

Another object of the present invention is to provide a method for controlling a washing machine, in which a laundry amount is again sensed even during a washing operation, thereby improving a user convenience much more.

Further another object of the present invention is to provide a method for controlling a washing machine, which is capable of prevent degradations of the parts and the washing performance in any cycle when using the washing machine.

According to one aspect of the present invention, a method for controlling a washing machine includes the steps of: sensing a laundry amount through a first laundry amount sensing process; judging whether or not the sensed laundry amount is in a substantial sensing range of the first laundry amount sensing process; and if the sensed laundry amount is in the substantial sensing range of the first laundry amount sensing process, performing the remaining cycles, and if the sensed laundry amount is out of the substantial sensing range of the first laundry amount sensing process, sensing again the laundry amount through a second laundry amount sensing process.

According to another aspect of the present invention, a method for controlling a washing machine includes the steps of: performing a washing operation; sensing an opening of a door during the washing operation; if the opening of the door is sensed, performing a laundry amount sensing process; and supplying a washing water additionally according to the sensed laundry amount when the laundry is added, and performing the washing operation.

According to further another aspect of the present invention, a method for controlling a washing machine includes the steps of: performing a washing operation according to information provided from a first laundry amount sensing process; sensing an opening of a door during the washing operation; judging a current progressing mode after the opening of the door is sensed; performing a second laundry amount sensing process in the current progressing mode; and controlling an amount of water supply when the laundry amount is changed according to the second laundry amount sensing process.

According to further another aspect of the present invention, a method for controlling an inverter motor direct driving washing machine includes the steps of: accelerating and rotating a tub directly driven by means of an inverter motor; measuring an elapse time until a rotation speed of the tub reaches a set speed; and sensing the laundry amount by comparing the measured time and a table storing laundry amounts based on preset time.

According to further another aspect of the present invention, a method for controlling an inverter motor direct driving washing machine includes the steps of: accelerating and rotating a tub directly driven by means of an inverter motor; inertia-rotating the tub after a rotation speed of the tub reaches a set speed; counting the number of revolutions during the inertia rotation of the tub; and sensing the laundry amount by comparing the counted number of revolutions and a table storing laundry amounts based on the preset number of revolutions.

The methods according to the present invention can sense the laundry amount more accurately and improve the user convenience. Further, the method according to the present invention can improve the stability of parts and the security in use.

BRIEF DESCRIPTION OF THE DRAWINGS

The above objects, other features and advantages of the present invention will become more apparent by describing the preferred embodiments thereof with reference to the accompanying drawings, in which.

BEST MODE FOR CARRYING OUT THE INVENTION

Hereinafter, preferred embodiments of the present invention will be described in detail with reference to the attached drawings. The present invention is not limited to the embodiments and it is apparent to those skilled in the art that the present invention can be easily applied to other embodiments within the spirit and scope of the present invention.

Figure 1:
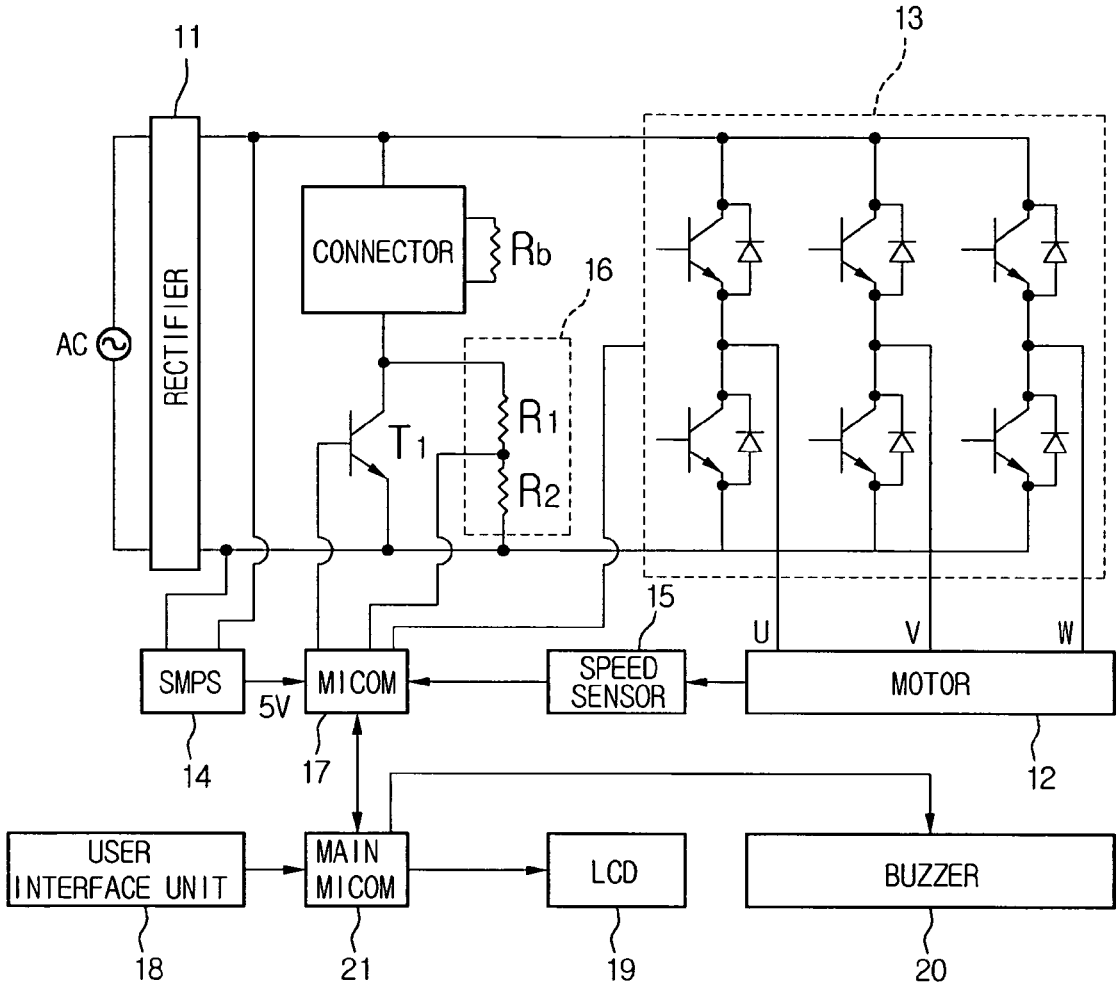
FIG. 1 is a block diagram illustrating a construction of a washing machine according to an embodiment of the present invention.

FIG. 1 is a block diagram illustrating a construction of a washing machine according to an embodiment of the present invention.

Referring to FIG. 1, the washing machine of the present invention includes: a rectifier 11 for rectifying a common AC power source; a motor 12 for supplying a torque to a tub or a pulsator of the washing machine; a driver 13 including inverters provided with a plurality of insulating gate bipolar transistors (IGBTs) and operating in a first mode for supplying three-phase (U/V/W) voltages to the motor 12 or in a second mode for regenerate a voltage generated due to a rotation of the motor through a reverse control of the motor 12 toward a circuit block; a switching mode power supply (SMPS) 14 for transforming an output of the rectifier 11 into a predetermined voltage (5V); a speed sensor 15 for sensing a rotation speed of the motor 12; a braking resistor Rb for dissipating a generation voltage of the motor 12, which is regenerated by the driver 13, into heat to thereby prevent a damage of circuit block; a transistor T1 for driving the braking resistor Rb; a voltage sensing unit 16 for sensing an output voltage level of the rectifier 11 across the braking resistor Rb; a micom 17 for controlling the driver 13 and the transistor T1 according to the outputs of the speed sensor 15 and the voltage sensing unit 16; a door switch (not shown) installed in a door to sense a user's opening of the door and inform it of the micom 17; a user interface unit 18 including a touch panel or a key input device, for inputting a variety of user commands; an LCD 19 for displaying an operation state of a washing machine, and the like; a buzzer 20; and a main micom 21 for controlling an overall operation of the washing machine.

Specifically, the main micom 21 performs a variety of data communications with the micom 17 in order to drive various loads, including the motor 12, according to the commands inputted through the user interface unit 18, in which the data communication includes a control signal. Additionally, an operation of driving the LCD 19 and the buzzer 20 is performed to output a preset warning message or alerting sound when a voltage higher than a power supply voltage is sensed through the communication with the micom 17.

Hereinafter, an operation of the washing machine constructed above will be described in brief.

First, if the user inputs a washing command through the user interface unit 18, the main micom 21 recognizes it and transfers a predetermined control signal to the micom 17 to thereby allow the loads to be driven according to a preset washing algorithm including a laundry amount sensing process.

The micom 17 controls the driver 13 to drive the pulsator or tub of the washing machine and senses the laundry amount. If the laundry amount is sensed, the micom 17 operates the driver 13 to rotate the motor 12 according to the output of the speed sensor 15 on the basis of the preset washing algorithm. Of course, the washing, rinsing and dewatering operations can be performed by driving the loads, such as a water supply valve, a drain valve, and the like.

Further, the main micom 21 controls the LCD 19 according to a current operation state to display an operation state, and it controls the buzzer 20 to generate an alerting sound according to the operation state.

Hereinafter, methods for controlling a washing machine according to embodiments of the present invention will be described in detail.

FIRST EMBODIMENT

Figure 2:
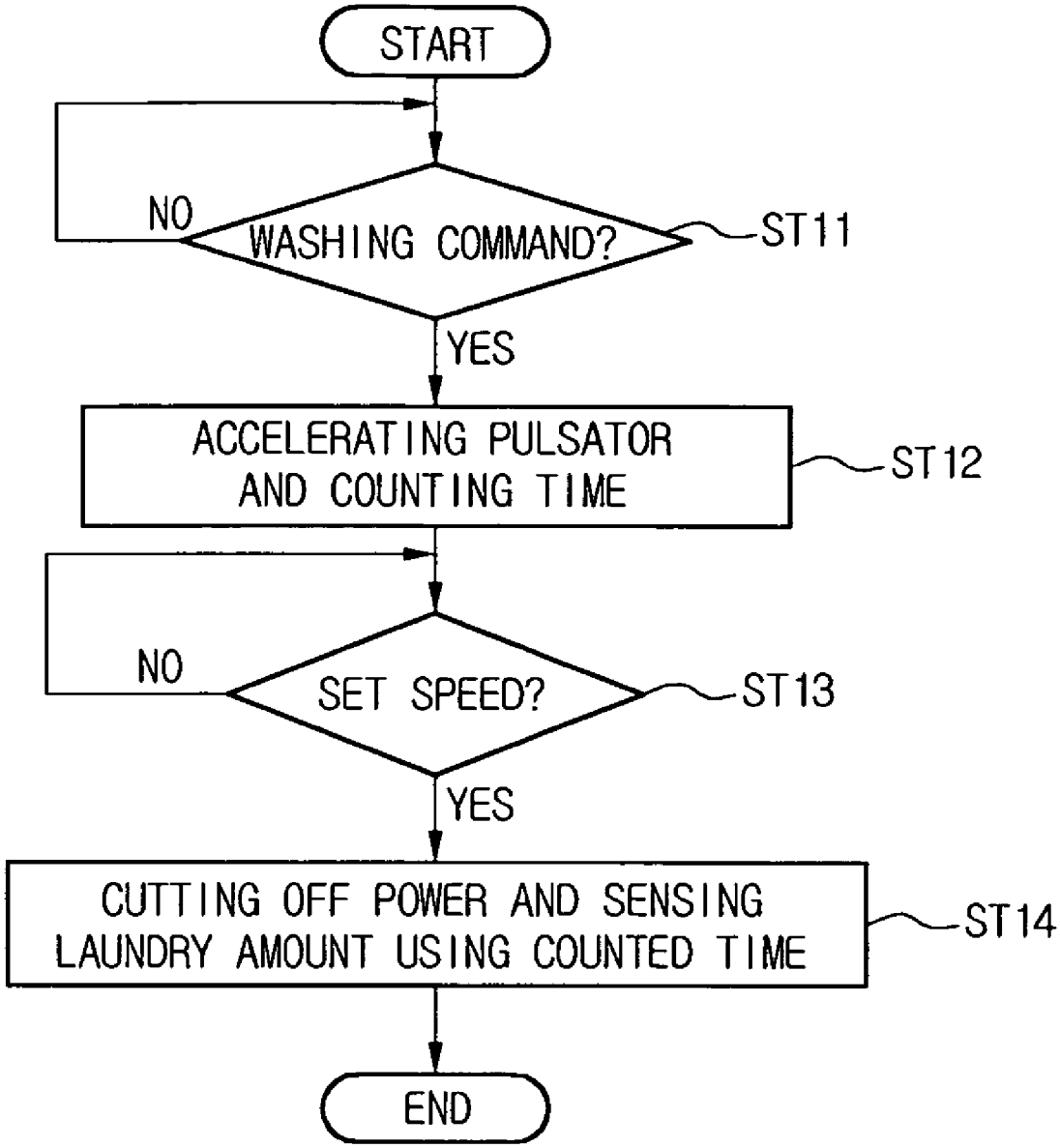
FIG. 2 is a flowchart illustrating a method for controlling a washing machine according to a first embodiment of the present invention.

FIG. 2 is a flowchart illustrating a method for controlling a washing machine according to a first embodiment of the present invention.

The main micom 21 judges whether or not the washing command is inputted (ST11). At this time, the washing command is inputted through the user interface unit 18 by the user.

If it is judged at the step ST11 that the washing command is inputted, the pulsator or tub of the washing machine is accelerated and an elapse time is measured by counting a time (ST12). At this time, the main micom 21 transfers a pulsator or tub acceleration command signal to the micom 17. If a rotation of the pulsator or tub is sensed using the output of the speed sensor 15, the main micom 21 begins to count a time. Additionally, the micom 17 controls the driver 13 according to the instruction of the main micom 21 to accelerate the pulsator or tub.

Then, it is judged whether or not the rotation speed of the pulsator or tub reaches a set speed (for example, 150 rpm) (ST13). If the rotation speed reaches the set speed, the power is cut off and the laundry amount is sensed using the time counted till that time (ST14). For example, because a load is large if the laundry amount is much, the counted time may be longer.

At this time, it is almost impossible to standardize the sensing of the laundry amount since the washing machines are different from each other in their structures and models, parts (especially, motor), and the like. Since their characteristics are different according to the products, tests are previously performed according to an actual laundry amount, and then, the laundry amount with respect to the rotation time until the set speed is stored in the main micom 21 and/or the micom 17 in a table form. Since the rotation time until the motor reaches the preset rotation speed according to the laundry amount is in advance stored in the table form, the corresponding laundry amount can be sensed by comparing the counted time and the table at the step ST14.

In this embodiment, the pulsator or tub is directly connected to a driving end portion of the motor and a belt or pulley is not directly intervened between the motor and the pulsator or tub. Therefore, this embodiment can be preferably applied to an inverter motor direct driving washing machine which can transfer the rotation of the pulsator or tub to the motor as it is. In other words, this embodiment can be preferably applied to the case the number of revolutions of the motor is identical to that of the pulsator or tub.

For this, a brushless DC motor (BLDC motor) can be applied as the motor and can be driven by the inverter circuit of the driver 13.

Meanwhile, since this embodiment is characterized in that the driving time of the motor is measured according to the loads of the laundry amount, this embodiment will be referred to as a "driving time measuring method".

SECOND EMBODIMENT

Figure 3:
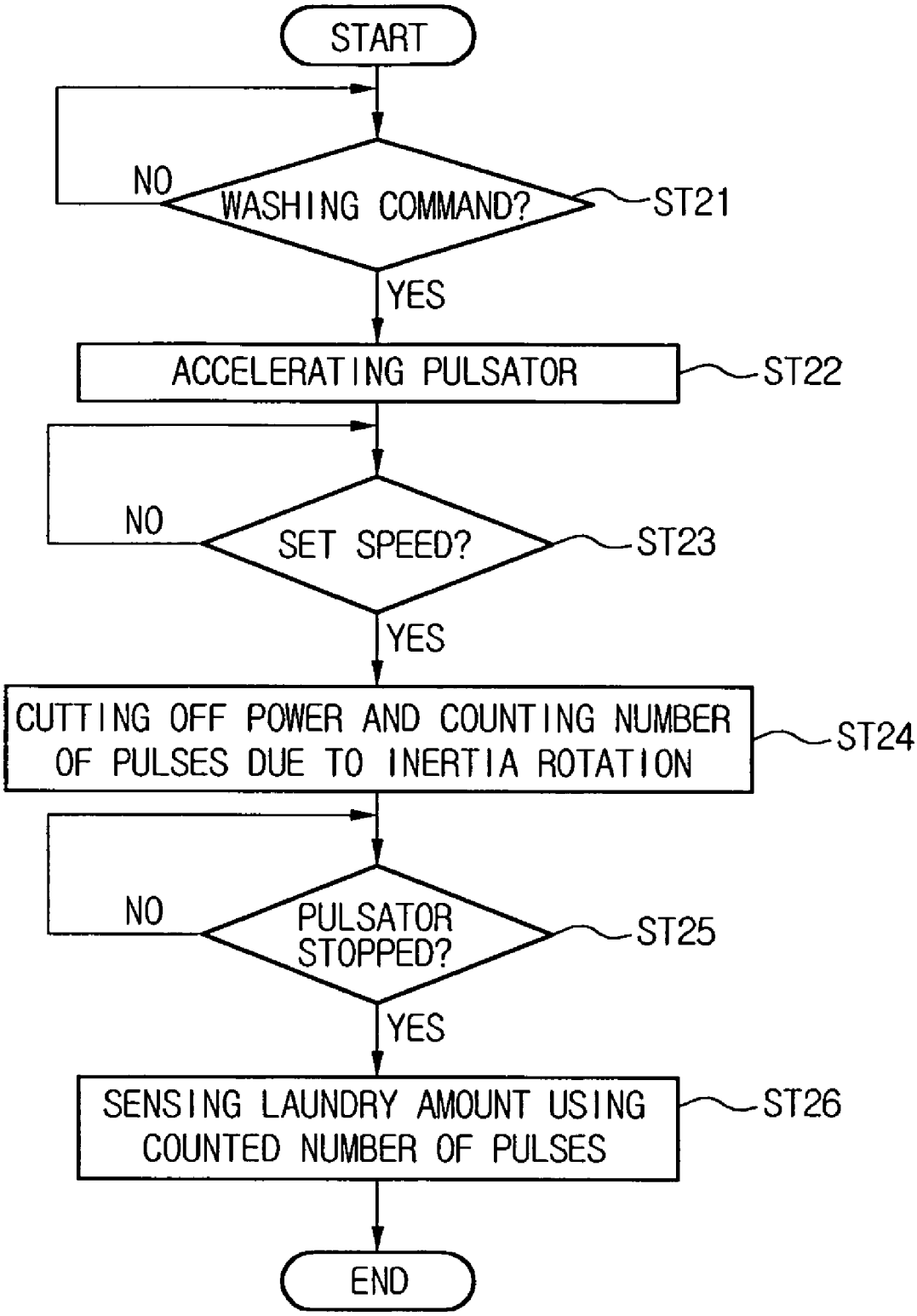
FIG. 3 is a flowchart illustrating a method for controlling a washing machine according to a second embodiment of the present invention.

FIG. 3 is a flowchart illustrating a method for controlling a washing machine according to a second embodiment of the present invention.

The main micom 21 judges whether or not the washing command is inputted (ST21). At this time, the washing command is inputted through the user interface unit 18 by the user. If it is judged at the step ST21 that the washing command is inputted, the pulsator or tub of the washing machine is accelerated (ST22) and it is judges whether or not the rotation speed of the pulsator or tub reaches a set speed (for example, 150 rpm) (ST23).

If it is judged at the step ST23 that the rotation speed reaches the set speed, the power is cut off and the pulsator or tub inertia-rotates. The number of pulses due to the inertia rotation, that is, the output of the speed sensor, is counted (ST24). At this time, the main micom 21 transfers a pulsator or tub acceleration command signal to the micom 17. Then, if the rotation speed of the pulsator or tub reaches the set speed according to the output of the speed sensor 15, the power is cut off and the number of the output pulses of the speed sensor 15 is counted. Meanwhile, the micom 17 controls the driver 13 according to the instruction of the main micom 21 to thereby accelerate the pulsator or tub of the washing machine.

Then, it is judged whether or not the pulsator or tub is stopped (ST25). If the pulsator or tub is stopped, the laundry amount is sensed using the counted number of the pulses (ST26). For example, because an inertia force is great if the laundry amount is much, the counted number of the pulses may be large since the pulsator or tub rotates for a long time. Of course, it can be different according to kinds, shapes and specifications of the washing machine.

Meanwhile, it is almost impossible to standardize the sensing of the laundry amount since the washing machines are different from each other in their structures and models, parts (especially, motor), and the like. Since their characteristics are different according to the products, tests are previously performed according to an actual quantity of laundry. The number of the pulses (i.e., the number of the output pulses of the speed sensor) while the inertia rotation is carried out after the arrival of the set speed is stored in the main micom 21 and/or the micom 17 in a table form.

Since the number of the pulses according to the laundry amount is stored in the table form, the corresponding laundry amount is sensed at the step ST26 by comparing the counted number of the pulses and the previously stored table.

Like the first embodiment, the second embodiment can be applied to an inverter motor direct driving washing machine. For this, a brushless DC motor (BLDC motor) can be applied as the motor and can be driven by the inverter circuit of the driver 13.

Meanwhile, this embodiment is characterized in that in case the rotation speed reaches the set speed, the number of revolutions of the motor (that is, the number of the pulses) is measured when the pulsator or tub inertia-rotates after the power is cut off. Therefore, this embodiment will be referred to as a "pulse number measuring method (or a revolution number measuring method".

THIRD EMBODIMENT

A method for controlling a washing machine according to a third embodiment of the present invention combines the driving time measuring method according to the first embodiment of the present invention and the pulse number measuring method according to the second embodiment of the present invention. Specifically, in case the laundry amount is much, the laundry amount sensing method according to the first embodiment of the present invention is preferably applied because it has a good reliability when an amount of laundry is much. Meanwhile, in case the laundry amount is less, the laundry amount sensing method according to the second embodiment of the present invention is preferably applied because it has a good reliability when an amount of laundry is less. Accordingly, this embodiment is characterized in that the laundry amount sensing method is applied appropriately according to the laundry amount received in the tub of the washing machine.

Figure 4:
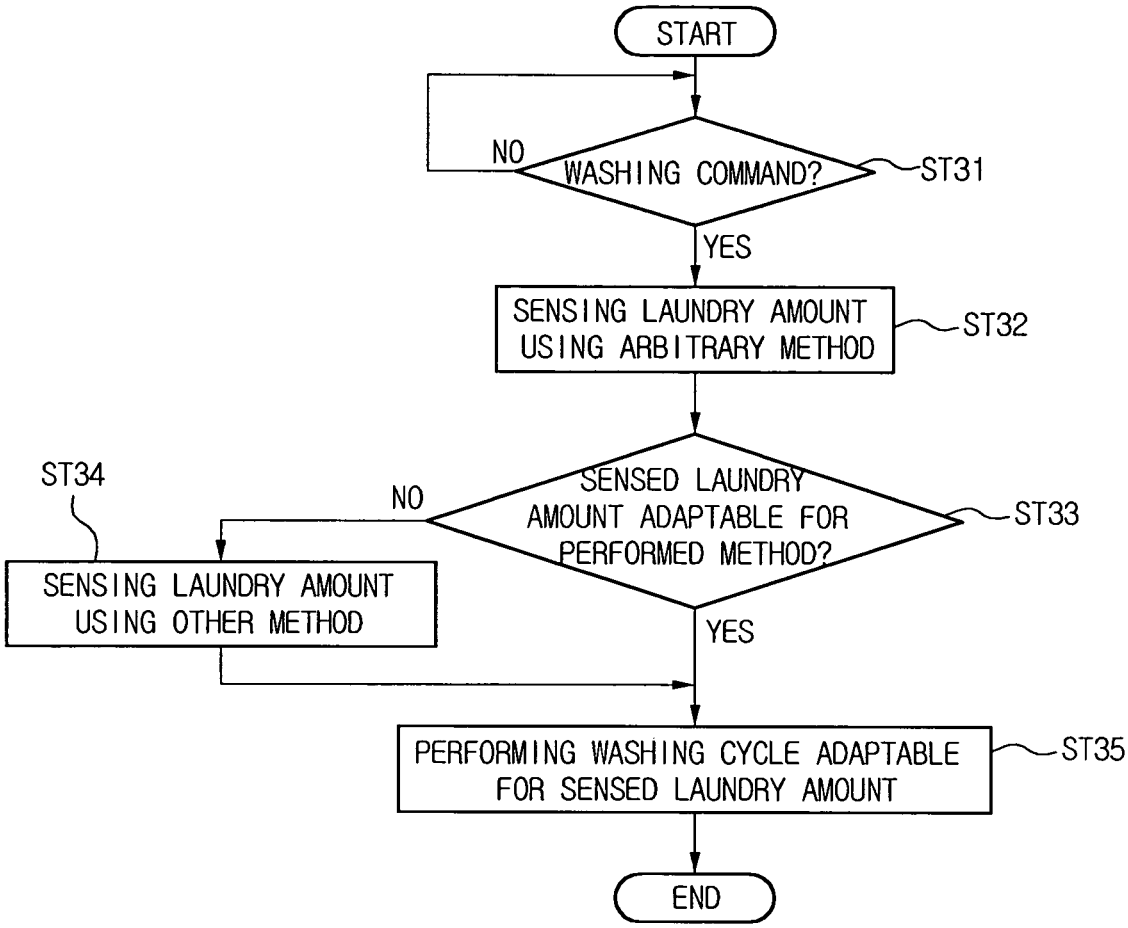
FIG. 4 is a flowchart illustrating a method for controlling a washing machine according to a third embodiment of the present invention.

FIG. 4 is a flowchart illustrating the method for controlling the washing machine according to the third embodiment of the present invention.

Referring to FIG. 4, the main micom 21 judges whether or not the washing command is inputted (ST31). At this time, the washing command is inputted through the user interface unit 18 by the user.

If the washing command is inputted, a first laundry amount sensing process is performed using one of the driving time measuring method and the pulse number measuring method (ST32). Then, it is judged whether or not the laundry amount sensed by the first laundry amount sensing process is in a range in which the first laundry amount sensing process can sense the laundry amount (ST33).

For example, in case the first laundry amount sensing process is the driving time measuring method and the driving time measuring method can be applied properly since the sensed laundry amount is more than a predetermined level, it is judged that the driving time measuring method is applied preferably. However, in case the sensed laundry amount is less than the predetermined level, it is judged that the driving time measuring method is not preferable.

In the similar manner, in case the first laundry amount sensing process is the pulse number measuring method and the pulse number measuring method is not applied appropriately since the sensed laundry amount is more than the predetermined level, it is judged that the pulse number measuring method is not preferable. However, in case the sensed laundry amount is less than the predetermined level, it is judged that the pulse number measuring method is applied correctly.

If it is judged at the step ST33 that the first laundry amount sensing process is suitable, all washing cycles adaptable for the sensed laundry amount are performed (ST35). However, if it is judged at the step ST33 that the first laundry amount sensing process is not suitable, a second laundry amount sensing process adaptable for the sensed laundry amount is performed (ST34). At this time, even when the second laundry amount sensing process is judged to be suitable, the first laundry amount sensing process may be performed once again in order to acquire more accurate information on the laundry amount.

All washing cycles are performed according to the laundry amount sensed by using the second laundry amount sensing process (ST35). In this manner, the laundry amount can be sensed more accurately.

Although the laundry amount sensing method is explained in two periods according to the laundry amount, methods for sensing more laundry amount and/or more periods can be applied.

Meanwhile, this embodiment of the present invention can use three laundry amount tables, which are stored in a storage device. Specifically, the laundry amount tables described in the first and second embodiments and the table storing threshold values of the laundry amount, which is judged to be adaptable, can be stored and used. Of course, if the possible cases of the laundry amount sensing methods are increased, the number of the tables may also be increased as many. Additionally, one threshold value may be additionally inserted into the above tables. Further, various methods, such as a method for counting the number of re-supplying water by supplying water to the tub and a method for calculating a slope of the rotation speed by rotating the tub, can be applied together with the above-described laundry amount sensing method.

Meanwhile, as described in the first and second embodiments, the first and second laundry amount sensing processes according to the third embodiment of the present invention can be applied to the inverter motor direct driving washing machine. Further, this embodiment of the present invention can also be applied to other type washing machines.

FOURTH EMBODIMENT

A method for controlling a washing machine according to a fourth embodiment of the present invention is proposed for improving the utilization of the first to third embodiments. In more detail, when the door of the washing machine is opened and the user performs other operations during any one of the washing cycles, the laundry may be loaded much more or unloaded. In this case, the laundry amount is sensed again, thereby correctly performing the washing cycles.

Figure 5:
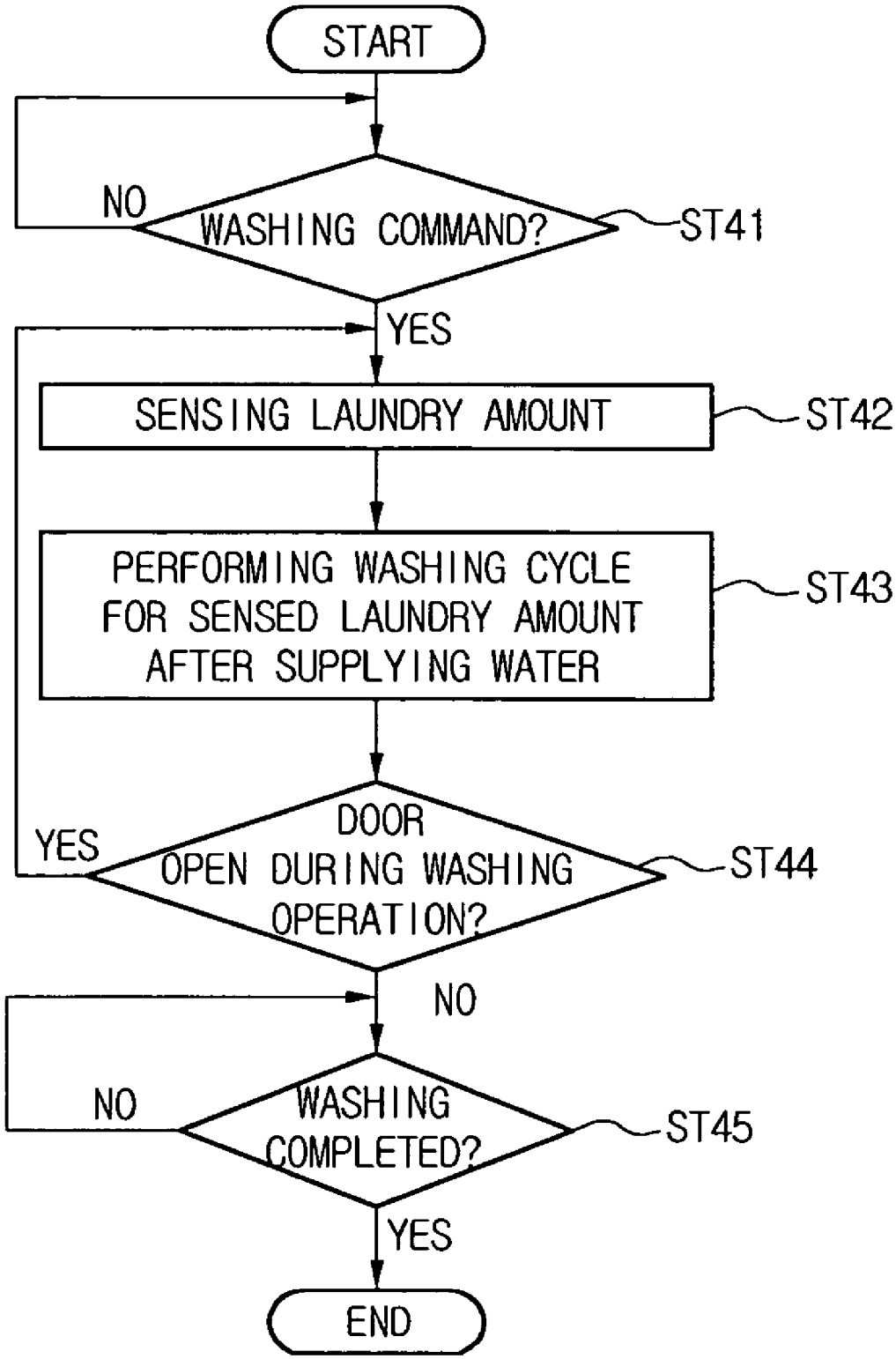
FIG. 5 is a flowchart illustrating a method for controlling a washing machine according to a fourth embodiment of the present invention.

FIG. 5 is a flowchart illustrating the method for controlling the washing machine according to the fourth embodiment of the present invention.

Referring to FIG. 5, the main micom 21 judges whether or not the washing command is inputted (ST41). At this time, the washing command is inputted through the user interface unit 18 by the user.

If it is judged at the step ST41 that the washing command is inputted, the main micom 21 outputs a control signal to the micom 17 and performs the operation of sensing the laundry amount by properly driving the various loads (ST42). Any laundry amount sensing method can be used and one of the above-described methods can also be used.

A washing water is supplied according to the laundry amount sensed at the step ST42 and a washing operation is then performed (ST43). It is judged whether or not the opening of the door is sensed through the door switch during the washing operation (ST44).

If it is judged at the step ST44 that the door is opened, an operation of, for example, stopping the washing machine is performed. Additionally, in case the door is opened, there is a strong possibility that the user additionally loads a laundry. Therefore, the steps ST42 and ST43 are performed again. That is, an operation of sensing the laundry amount and re-supplying the washing water according to the sensed laundry amount and an operation of performing the washing operation are performed. At this time, if the laundry is loaded additionally, the washing water is re-supplied according to the added laundry amount and the washing operation is then performed. Of course, if no additional laundry is loaded, the original amount of the washing water can be used to perform the remaining washing cycles. Further, in case the laundry is unloaded, a predetermined amount of the washing water may be drained out.

At this time, in case the door is opened while any washing cycle is performed, the progressing operation is stopped. Then, the process returns to the cycle when the laundry is loaded initially, and the laundry amount is sensed again. Even at this time, since the laundry may be soaked in the washing water, a table different from the table for measuring the dried laundry amount may be applied.

Of course, in case no opening of the door is sensed at the step ST44, the washing operation continues to be performed and it is judged whether or not the washing operation is completed (ST45). If the washing operation is completed, the cycle may be ended.

According to this embodiment of the present invention, even when the user loads the laundry again, it is sensed and the washing operation is performed by supplying the washing water according to the sensed laundry amount. Therefore, it is possible to prevent the degradation of the washing performance and the damage of parts due to the increase of the loads. As a result, this embodiment has advantages in that the washing performance is improved and the lifetime of product is prolonged.

FIFTH EMBODIMENT

A method for controlling a washing machine according to a fifth embodiment of the present invention is mostly similar to the method described in the fourth embodiment of the present invention. In this embodiment, in case the door is opened, it is judged at which cycle the washing machine operates. Therefore, even when the door is opened during the washing operation, all washing cycles can be performed rapidly.

Figure 6:
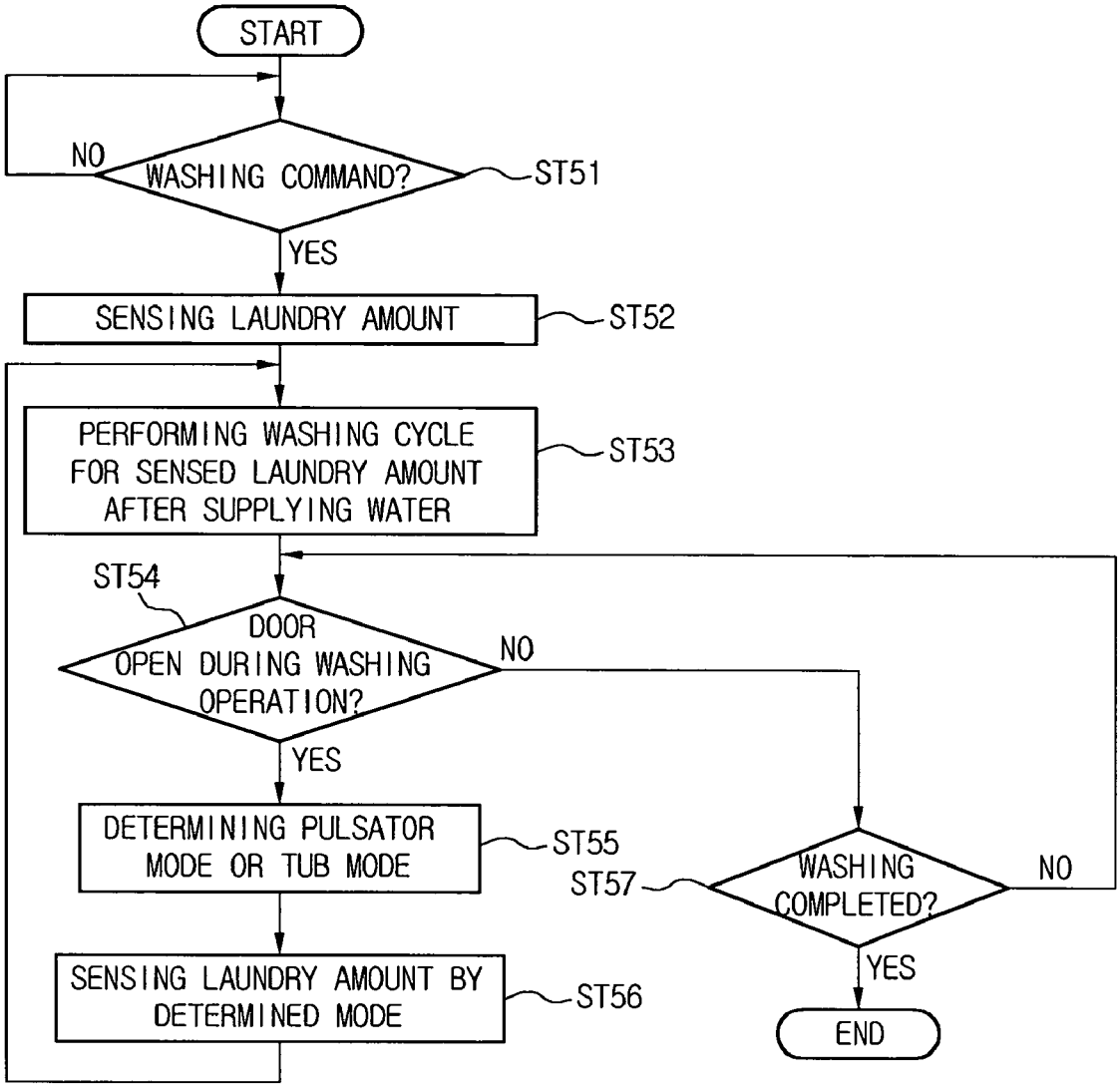
FIG. 6 is a flowchart illustrating a method for controlling a washing machine according to fifth embodiment of the present invention.

FIG. 6 is a flowchart illustrating the method for controlling the washing machine according to the fifth embodiment of the present invention.

Referring to FIG. 6, the main micom 21 judges whether or not the washing command is inputted (ST51). At this time, the washing command is inputted through the user interface unit 18 by the user.

If it is judged at the step ST51 that the washing command is inputted, the main micom 21 outputs a control signal to the micom 17 and performs the operation of sensing the laundry amount by properly driving the various loads (ST52). Various methods including the above-described methods can be used for sensing the laundry amount. Then, the washing water is supplied according to the laundry amount sensed at the step ST52 and a washing operation is then performed (ST53).

Then, it is judged whether or not the opening of the door is sensed through the door switch during the washing operation (ST54). If it is judged at the step ST54 that the door is opened, there is a strong possibility that the user additionally loads a laundry. Therefore, a current progressing mode is checked (ST55). The current progressing mode can be divided into a pulsator mode and a tub mode. Here, the pulsator mode is a mode in which only the pulsator is driven during the washing and rinsing operations, and the tub mode is a mode in which the tub and the pulsator are simultaneously driven during the dewatering operation. Of course, the current progressing mode can be judged as other modes divided in a different manner. For example, one of them is a mode in which the water supply is progressed or a mode in which the washing water is drained out after a series of washing operations are ended.

Then, the laundry amount is sensed in the mode checked at the step ST55 (ST56).

In more detail, when the door is opened during the washing operation, the current progressing mode is checked and the laundry amount is sensed in the check mode. The reason is because a predetermined time is taken to switch from the current progressing mode to the preset mode and thus all cycles are delayed, if the mode for sensing the laundry amount is previously set up as a preset mode and the current progressive mode is not the preset mode.

Accordingly, the time necessary for all cycles can be reduced by checking the current progressing mode of the washing machine and sensing the laundry amount in the checked mode. Specifically, there is no problem in the washing operation even when the user himself or herself washes the laundry according to the progressing state of the washing machine or puts the laundry into the washing machine after rinsing the laundry.

Meanwhile, in case the door is opened and the laundry amount is sensed again, there are many cases that the washing water is supplied, as well as the dried laundry. Therefore, at the step ST56 of sensing the laundry amount again, a method for counting the number of water re-supply by supplying the washing water to the tub and a method for sensing the laundry amount using data related to an amount of washing water can be performed. In addition, in a state that the laundry amount sensed at the previous laundry amount sensing step and the data relating to the amount of the supplied washing water are stored, a method for sensing an amount of the newly added laundry is applied. Alternatively, the added laundry amount can be measured according to a new table relating to both the laundry amount and the washing water.

Then, the process returns to the step S53 of supplying the washing water according to the sensed laundry amount and performing the washing operation. Of course, if the sensed laundry amount is not increased, the remaining washing operation is performed without supplying the washing water. In case the laundry is unloaded, the washing water may be reduced through the drain operation.

If the opening of the door is not sensed at the step ST54, the washing operation continues to be performed and it is judged whether or not the washing operation is completed (ST57). If the washing operation is completed, the process is ended.

Meanwhile, if it is judged at the step ST57 that the washing operation is not completed, the process proceeds to the step ST54 and performs the remaining steps ST55 to ST57.

Even when the user loads the laundry again in any mode during the washing operation, it is sensed and the current progressing mode (for example, the pulsator mode or the tub mode) is checked. Then, the laundry amount is sensed in the current progressing mode and the washing operation is performed by supplying the washing water according to the final laundry amount. Accordingly, it is possible to prevent the degradation of the washing performance and the damage of parts due to the increase of loads. As a result, the cycle delay due to the sensing of the laundry amount during the washing operation can be minimized, thereby improving the washing performance. Further, the reliability of the product is improved and the lifetime of the product is prolonged.

INDUSTRIAL APPLICABILITY

According to the present invention, it is possible to sense more accurately the laundry amount loaded into the tub. Further, the present invention provides the method for controlling the washing machine, which can improve the user convenience much more by re-sensing the laundry amount during the washing operation.

Furthermore, the method according to the present invention makes it possible to again sense the quantity of laundry in any of all washing cycles, thereby preventing the degradations of parts and washing performance.

The invention claimed is:

1. A method for controlling a washing machine, comprising the steps of:

sensing a laundry amount through a first laundry amount sensing process;

judging whether or not the sensed laundry amount is in a substantial sensing range of the first laundry amount sensing process; and if the sensed laundry amount is in the substantial sensing range of the first laundry amount sensing process, performing the remaining cycles, and if the sensed laundry amount is out of the substantial sensing range of the first laundry amount sensing process, sensing again the laundry amount through a second laundry amount sensing process, wherein the second laundry amount sensing process is different from the first laundry sensing process, and is selected based upon the sensed laundry amount.

2. The method according to claim 1, wherein the first and second laundry amount sensing processes differently select any one of a driving time measuring method, a pulse number measuring method, a method of supplying a washing water to a tub and counting the number of water re-supply, and a method of rotating the tub and calculating a slope of a rotation speed.

3. The method according to claim 1, wherein the sensing range is read out from a table storing threshold values, the threshold values being previously determined suitably according to the laundry amount sensing processes.

4. The method according to claim 1, wherein the remaining cycles are controlled according to laundry amount information, the laundry amount information being read out from a table storing information classified within the substantial sensing range.

5. The method according to claim 1, wherein in case the first laundry amount sensing process is a driving time measuring method and the second laundry amount sensing process is a pulse number measuring method, the first laundry amount sensing process having the sensing range substantially higher than the second laundry amount sensing process.

6. The method according to claim 1, wherein the first laundry amount sensing process is a driving time measuring method and the second laundry amount sensing process is a pulse number measuring method.

7. The method according to claim 1, further comprising the step of performing again the first laundry amount sensing process before the remaining cycles in order to acquire more accurate information.

* * * * *